US012702238B2

(12) United States Patent
Bryant et al.

(10) Patent No.: US 12,702,238 B2
(45) Date of Patent: Aug. 11, 2026

(54) SUPPORT CUSHIONS INCLUDING FOAM ARCHES

(71) Applicant: COMFORT REVOLUTION, LLC, Lexington, KY (US)

(72) Inventors: Brian Bryant, Fulton, MS (US); David Harris, Mantachie, MS (US); Timothy Strother, Iuka, MS (US)

(73) Assignee: COMFORT REVOLUTION, LLC, Lexington, KY (US)

( * ) Notice: Subject to any disclaimer, the term of this patent is extended or adjusted under 35 U.S.C. 154(b) by 55 days.

(21) Appl. No.: 18/681,183

(22) PCT Filed: Aug. 5, 2022

(86) PCT No.: PCT/US2022/039573
§ 371 (c)(1),
(2) Date: Feb. 5, 2024

(87) PCT Pub. No.: WO2023/014971
PCT Pub. Date: Feb. 9, 2023

(65) Prior Publication Data

US 2025/0127309 A1 Apr. 24, 2025

Related U.S. Application Data

(60) Provisional application No. 63/229,756, filed on Aug. 5, 2021.

(51) Int. Cl.
*A47C 27/14* (2006.01)
*A47C 27/15* (2006.01)

(52) U.S. Cl.
CPC ..... *A47C 27/144* (2013.01); *A47C 27/148* (2013.01); *A47C 27/15* (2013.01)

(58) Field of Classification Search
None
See application file for complete search history.

(56) References Cited

U.S. PATENT DOCUMENTS 3,678,553 A * 7/1972 Hermelin ..... A47C 3/12 297/452.17
4,407,031 A 10/1983 Michiels
(Continued)

FOREIGN PATENT DOCUMENTS

JP H09-131244 A 5/1997
JP 2004242798 A 9/2004
(Continued)

OTHER PUBLICATIONS

United States Patent and Trademark Office, International Search Report and Written Opinion issued in corresponding Application No. PCT/US2022/039573, mailed Oct. 26, 2022.
(Continued)

*Primary Examiner* — Adam C Ortiz
(74) *Attorney, Agent, or Firm* — Stites & Harbison, PLLC; Terry L. Wright; Collin M. Aycock

(57) ABSTRACT

A support cushion includes a tub defining a well and a plurality of foam arches positioned in the well. Each foam arch includes an upper curved portion, and each foam arch is positioned in the well such that each upper curved portion is opposite a bottom panel of the tub. A body supporting layer having a first surface and a second surface opposite the first surface is positioned over the well and atop the plurality of flexible foam arches.

24 Claims, 5 Drawing Sheets

(56) References Cited

U.S. PATENT DOCUMENTS

| | | | | |
|---|---|---|---|---|
| 5,044,027 | A | 9/1991 | Moon | |
| 6,839,929 | B2 | 1/2005 | Stolpmann | |
| 8,266,747 | B1 * | 9/2012 | Sobran | A47C 27/003 5/678 |
| 8,561,236 | B2 | 10/2013 | Witherell et al. | |
| 2008/0060139 | A1 | 3/2008 | Mossbeck | |
| 2011/0061163 | A1 * | 3/2011 | Lee | A47C 27/056 5/717 |
| 2013/0000047 | A1 * | 1/2013 | McCann | A47C 27/128 5/709 |
| 2015/0289669 | A1 * | 10/2015 | Reynolds | A47C 27/144 5/690 |
| 2019/0239654 | A1 * | 8/2019 | Cohen | A47C 27/066 |

FOREIGN PATENT DOCUMENTS

| | | | |
|---|---|---|---|
| JP | 2007167627 | A | 7/2007 |
| JP | 2009279086 | A | 12/2009 |

OTHER PUBLICATIONS

European Patent Office, Extended European Search Report issued in corresponding Application No. 22853953.2 dated Aug. 18, 2025.

* cited by examiner

SUPPORT CUSHIONS INCLUDING FOAM ARCHES

RELATED APPLICATIONS

This application claims priority from U.S. Provisional Application Ser. No. 63/229,756, filed Aug. 5, 2021, the entire disclosure of which is incorporated herein by this reference.

TECHNICAL FIELD

The present invention relates to support cushions including a plurality of flexible foam arches. In particular, certain embodiments of the present invention relate to support cushions, such as mattress assemblies, that include a plurality of flexible foam arches positioned in an interior of the support cushion and configured to provide sustained energy and continual support to an individual resting on the support cushion.

BACKGROUND

An aspect of successful and restful sleep is individual sleep comfort and the support provided by a mattress, or other support cushion, is an important component of such sleep comfort. Medical research suggests that sleep deprivation ("sleep debt") can have significant negative impacts on longevity, productivity, and overall mental, emotional, and physical health. Chronic sleep debt has been linked to weight gain and, more specifically, has been observed to not only affect the way the body processes and stores carbohydrates, but has also been observed to alter hormone levels that affect appetite. Moreover, sleep debt may result in irritability, impatience, inability to concentrate, and moodiness, which has led some researchers to suggest a link between sleep debt and worksite accidents, traffic incidents, and general afternoon inattentiveness. Furthermore, sleep disorders have been linked to hypertension, increased stress hormone levels, and irregular heartbeats, and additional research has recently suggested that a lack of sleep can affect immune function, resulting in increased susceptibility to illness and disease, e.g., cancer. In all, researchers have now suggested that sleep debt costs the United States billions of dollars annually in lost productivity due to these various effects. Accordingly, a support cushion that improves sleep comfort and that improves upon the support provided by the support cushion, and thereby lowers individual sleep debt, would be both highly desirable and beneficial.

SUMMARY

The present invention includes support cushions having a plurality of foam arches positioned in an interior of the support cushion and configured to provide sustained energy and continual support to an individual resting on the support cushion.

In some exemplary embodiments of the present invention, a support cushion includes a tub with a bottom panel and a sidewall collectively defining a well. The support cushion further includes a plurality of foam arches positioned in the well. Each foam arch includes an upper curved portion, and each foam arch is positioned in the well such that each upper curved portion is opposite the bottom panel of the tub. The support cushion further includes a body supporting layer having a first surface and a second surface opposite the first surface, and the second surface of the support cushion is positioned over the well and atop the plurality of flexible foam arches.

In some exemplary embodiments, the well of the tub has a width, and each foam arch has a length spanning the width of the well. Further, in some exemplary embodiments, the tub has a longitudinal axis, and the upper curved portion of each foam arch extends in a same direction as the longitudinal axis of the tub. In some exemplary embodiments, each foam arch is independent from each other foam arch. In some particular embodiments, each foam arch is encased in a fabric. In some other exemplary embodiments, each foam arch is affixed to an adjacent foam arch. For instance, in some particular embodiments, a fabric band extends along a longitudinal axis of the tub and the fabric band is affixed to an edge surface of each foam arch to connect the plurality of foam arches. In some exemplary embodiments, each foam arch is in the shape of a round arch.

In some exemplary embodiments, the body supporting layer and the plurality of foam arches are comprised of a flexible foam. In some exemplary embodiments, the body supporting layer is comprised of a visco-elastic foam. In some exemplary embodiments, the tub is comprised of a flexible foam, and the flexible foam comprising the body supporting layer has a density less than a density of the flexible foam comprising the tub. In some exemplary embodiments, the sidewall of the tub includes an inner support encased in a flexible foam.

Further features and advantages of the present invention will become evident to those of ordinary skill in the art after a study of the description, figures, and non-limiting examples in this document.

DESCRIPTION OF EXEMPLARY EMBODIMENTS

The present invention includes support cushions having a plurality of foam arches positioned in an interior of the support cushion and configured to provide sustained energy and continual support to an individual resting on the support cushion.

Figure 1:
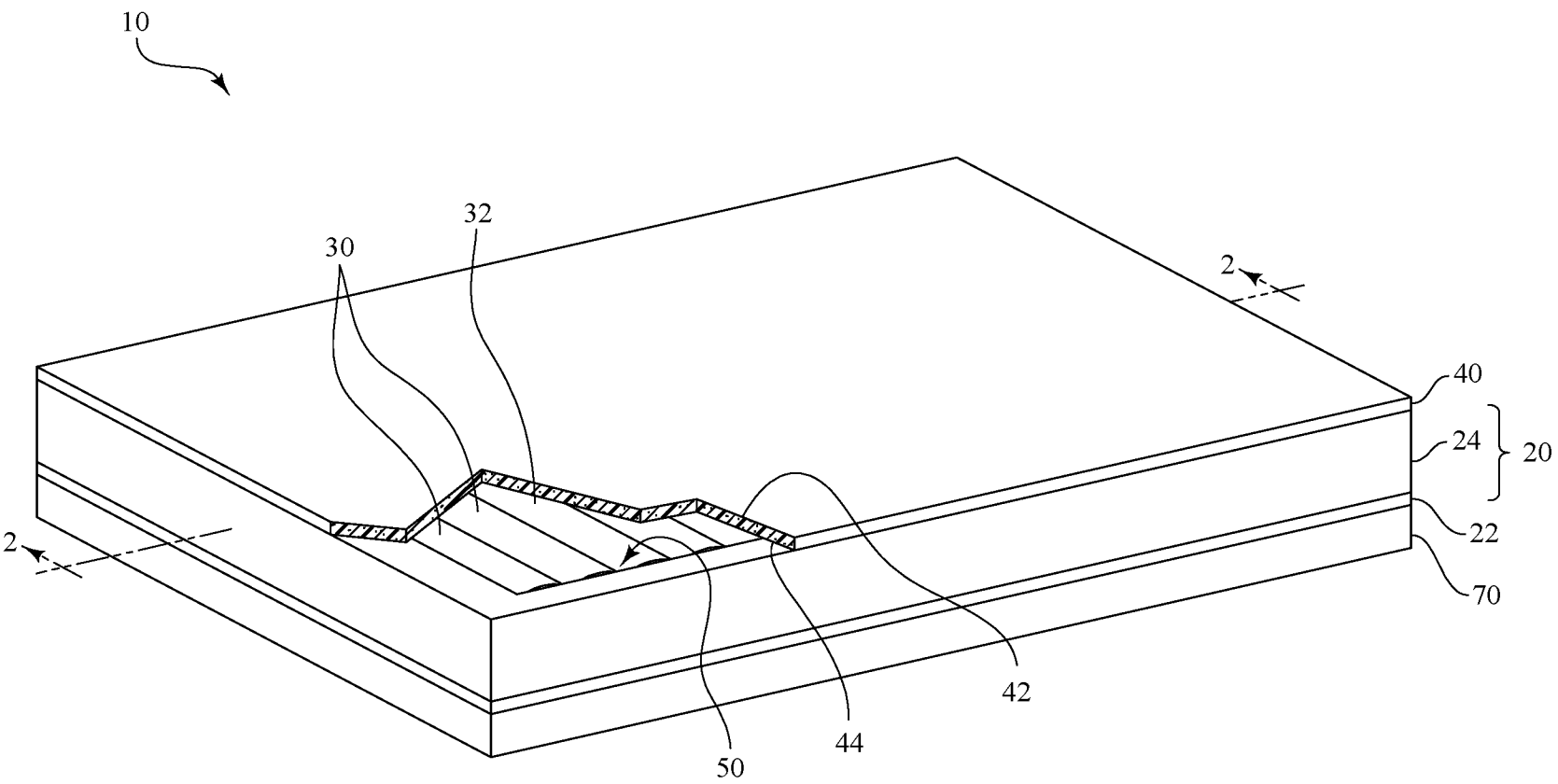
FIG. 1 is perspective view of a mattress assembly made in accordance with the present invention, and including a portion of the body supporting layer of the mattress assembly removed to show underlying foam arches.

Referring first to FIG. 1, in one exemplary embodiment of the present invention, a support cushion in the form of a mattress assembly 10 is provided that includes a tub 20 having a bottom panel 22 and a sidewall 24 that collectively define an interior cavity or well 50 of the tub 20. A plurality of foam arches 30 is further included in the mattress assembly 10 and is positioned in the well 50 of the tub 20. More specifically, each foam arch 30 is positioned in the well 50 such that the length of each foam arch 30 spans the width of the well 50 and such that a curved portion 32 of each foam arch 30 extends in the same direction as the longitudinal axis of the tub 20. A body supporting layer 40 having a first surface 42 and a second surface 44 opposite the first surface 42 is then also included in the mattress assembly 10. The second surface 44 of the body supporting layer 40 is positioned over and covers the well 50 and associated tub 20, but is also positioned atop and covers the plurality of foam arches 30. In this way, each of the foam arches 30 are thus in contact with the second surface 44 of the body supporting layer 40 and are configured to provide support to the body supporting layer 40 and, in turn, a user resting on the mattress assembly 10, as discussed further below. The exemplary mattress assembly 10 further includes a base layer 70 positioned below and supporting the bottom panel 22 of the tub 20, as also discussed further below.

Figure 2:
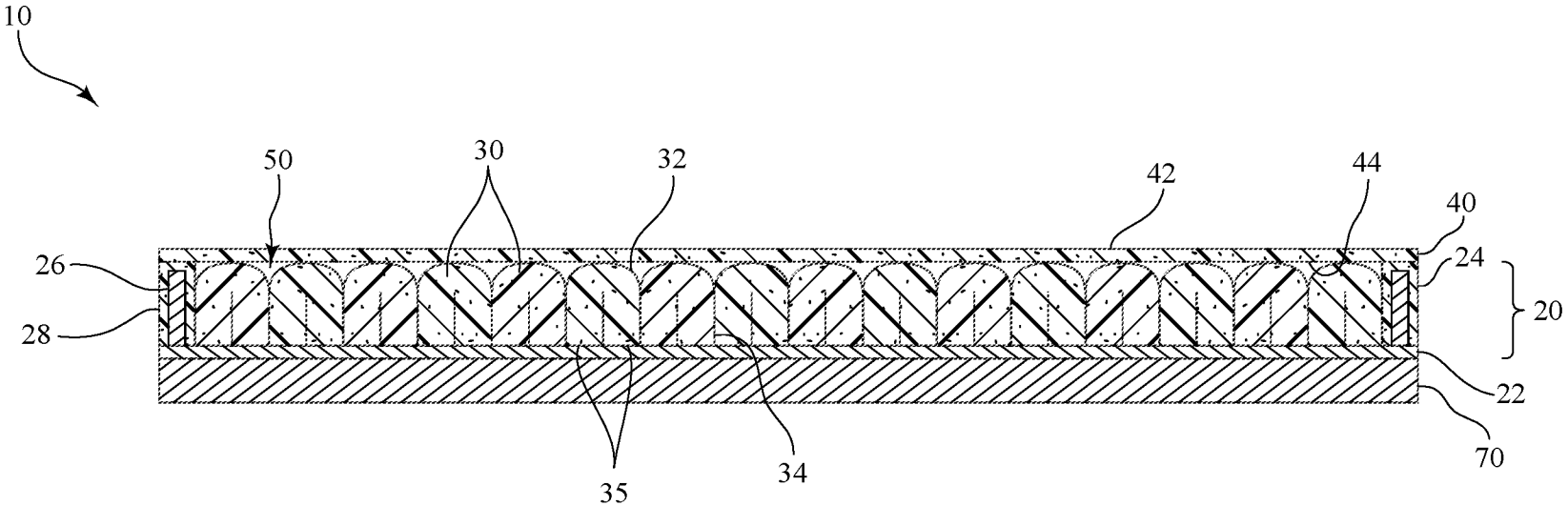
FIG. 2 is a side sectional view of the mattress assembly of FIG. 1 taken along line 2-2 shown in FIG. 1.
Figure 3A:
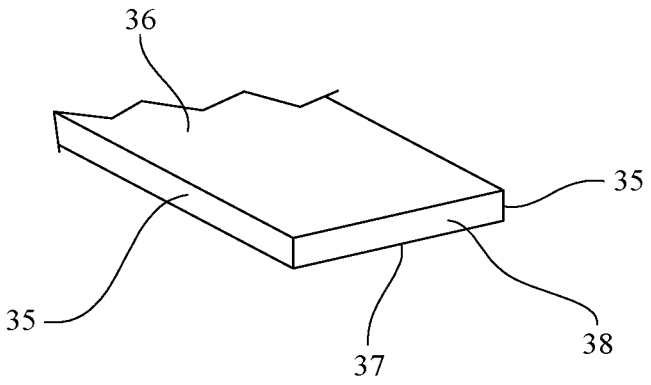
FIG. 3A is a partial perspective view of a flexible foam used to form an exemplary foam arch shown in FIG. 1.
Figure 3B:
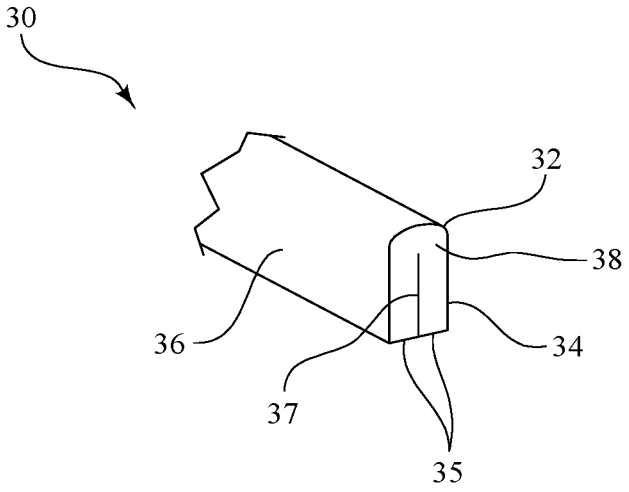
FIG. 3B is a partial perspective view of the flexible foam of FIG. 3A after it has been bent to form the foam arch.

Referring now to FIGS. 2, 3A, and 3B, each of the exemplary foam arches 30 is comprised of a single piece of flexible foam that is bent into the shape of a round arch such that each of the foam arches 30 includes an upper curved portion 32 and a flat end portion 34 opposite the upper curved portion 32. More specifically, as shown in FIG. 3A, prior to bending, the flexible foam is a substantially rectangular slab of foam which can be characterized as having a first surface 36, a second surface 37 opposite from the first surface 36, two end surfaces 35 that extend between the first surface 36 and the second surface 37 along a long axis of the slab of foam, and two edge surfaces 38 (only one shown) that extend between the first surface 36 and the second surface 37 along a short axis of the slab of foam. As shown in FIG. 3B, upon bending the flexible foam, the two end surfaces 35 are brought towards each other such that the second surface 37 is folded in upon itself to become an inner surface 37 of the foam arch 30 and such that the first surface 36 becomes an outer surface 36 of the foam arch 30. As previously mentioned, the resulting foam arch 30 can also be characterized as having a curved portion 32 where the foam piece was bent and having an end portion 34 opposite from the curved portion 32 were the two end surfaces 35 were brought towards each other.

In the exemplary embodiment shown in FIGS. 1, 2, and 3B, the foam arches 30 are held together with an adhesive, e.g., a water based glue or hot melt glue, that is applied to the inner surface 37 of the flexible foam prior to folding. In some particular embodiments, the adhesive is applied only to a portion of the inner surface 37 such as a 2" section of the end portion 34 immediately adjacent to the end surfaces 35. Of course, other means of maintaining the shape of the foam arch are also possible without departing from the spirit and scope of the present invention including, but not limited to, sewing, tufting, heat welding, and sonic welding. As discussed further below, in some other embodiments additional components are used to form and/or maintain the shape of the foam arches.

Accordingly, and as shown in FIG. 2, each of the foam arches 30 are independent of one another and are positioned in the well 50 of the tub 20 adjacent to one another with the end portion 34 of each foam arch 30 within the well 50 and the two end surfaces 35 positioned against the bottom panel 22 of the tub 20. The upper curved portion 32 of each foam arch 30 is therefore positioned opposite the bottom panel 22 of the tub 20 with the foam arches 30 extending to the same height as or slightly above the sidewall 24 of the tub 20. When the body supporting layer 40 is placed over and contacts the upper curved portion 32 of each of the foam arches 30, the foam arches 30 are thus positioned and configured to provide sustained energy and continued support to the body supporting layer 40 of the mattress assembly 10. Specifically, by configuring the foam arches 30 in such a manner, the foam arches 30 are able to provide sustained energy and continued support not only by virtue of the natural push-back and bounce present in an arch itself, but also by virtue of the sides and end portions of each of the foam arches 30 pushing against the sides and end portions of adjacent foam arches 30 and/or the tub 20 to thereby create push-back energy upon compression. Moreover, the arrangement of the foam arches 30 provides a mechanism by which a natural bounce can be added to an all-foam mattress and by which air flow and recovery from compression can be improved, both of which, in turn, then lead to a longer life of a mattress assembly.

As mentioned above, the plurality of foam arches 30 of the mattress assembly 10 are generally comprised of a flexible foam. In particular, the flexible foam used in the foam arches 30 is suitable for providing a requisite amount of support to the body supporting layer 40, but also providing the required resistance to compression and sustained energy or "push-back." Such flexible foams capable of use in accordance with the present invention include, but are not limited to, latex foam, reticulated or non-reticulated visco-elastic foam (sometimes referred to as memory foam or low-resilience foam), reticulated or non-reticulated non-visco-elastic foam, polyurethane high-resilience foam, expanded polymer foams (e.g., expanded ethylene vinyl acetate, polypropylene, polystyrene, or polyethylene), and the like. In the embodiment shown in FIGS. 1-2, each of the foam arches 30 are comprised of a flexible foam having a sufficient resilience, density, and hardness, which allows the foam arches 30 to provide sufficient resistance against compression and, in turn, push-back against the body supporting layer 40 and adjacent foam arches 30 upon compression. Generally, such flexible foams have a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 2439 hardness measuring standard. In some embodiments, the flexible foam comprising the foam arches 30 has a hardness of about 10 N, about 20 N, about 30 N, about 40 N, about 50 N, about 60 N, about 70 N, or about 80 N to provide a desired degree of compression resistance and support to the body supporting layer 40.

The flexible foam described herein for use in the foam arches 30 can also have a density that assists in providing a desired degree of compression resistance and other qualities, as well as an increased degree of material durability. In some embodiments, the density of the flexible foam used in the foam arches 30 has a density of no less than about 30 kg/m$^3$ to no greater than about 150 kg/m$^3$. In some embodiments, the density of the visco-elastic foam used in the foam arches 30 of the mattress assembly 10 is about 30 kg/m$^3$, about 40 kg/m$^3$, about 50 kg/m$^3$, about 60 kg/m$^3$, about 70 kg/m$^3$, about 80 kg/m$^3$, about 90 kg/m$^3$, about 100 kg/m$^3$, about 110 kg/m$^3$, about 120 kg/m$^3$, about 130 kg/m$^3$, about 140 kg/m$^3$, or about 150 kg/m$^3$. Of course, the selection of a flexible foam having a particular density will affect other characteristics of the foam, including its hardness, the manner in which the foam responds to pressure, and the overall feel of the foam, but it is appreciated that a flexible foam having a desired density and hardness, as well as a particular size, weight, and shape, can readily be selected for a particular application or mattress assembly as desired and in order to provide foam arches having varying degrees of support and comfort to a user lying on an exemplary mattress assembly of the present invention. In some embodiments, the flexible foam used in accordance with the present invention can be characterized or described as having an Indentation Force Deflection ("IFD") of between 20 to 40 lbs. and a density of 1 to 2 lbs. per cubic foot.

In addition to the foam arches 30 being comprised of a flexible foam, the tub 20 of the mattress assembly 10 is also generally comprised of a flexible foam. As shown in FIG. 2, the exemplary sidewalls 24 include an inner support 26 and foam encasement 28. The inner support 26 and the bottom panel 22 are comprised of a flexible foam with a sufficient density and hardness for securing the plurality of flexible foam arches 30 in the tub 20 and for supporting the body supporting layer 40 of the mattress assembly 10. The flexible foam comprising the foam encasement 28, on the other hand, typically has a density less than that of the inner support 26 to as to provide a softer edge for the mattress assembly 10. Such visco-elastic foams can similarly have hardness values in the range of about 10 N to no greater than about 80 N and density values in the range of about 30 kg/m$^3$ to about 150 kg/m$^3$, but it is of course contemplated that a flexible foam, including other flexibles foams such as latex or soft conventional foams, having a desired density, hardness, or other property can also readily be selected for a particular application or mattress assembly as desired. In some embodiments, there may be no inner support at all and the sidewalls are made of a single piece of foam having appropriate support characteristics. In some other embodiments, the inner support, the bottom panel, or both the inner support and bottom panel may not be made of a foam but instead made of a rigid or semi-rigid material, e.g., plastic or wood.

The exemplary body supporting layer 40 of the mattress assembly 10 is also comprised of a flexible foam, but the flexible foam of the body supporting layer 40 typically has a density less than that included in the sidewalls 24 of the tub 20 and is generally suitable for distributing pressure from a user's body, or portion thereof, across the body supporting layer 40. For example, in some embodiments, the flexible foam comprising the sidewalls 24 of the tub 20 will have density and/or hardness similar to the observed with the foam arches 30 (described above), while the body supporting layer 40 has a density or hardness that is less than that present in the foam arches 30. In this regard, the body supporting layer 40 can be comprised of a visco-elastic foam that has a low resilience as well as a sufficient density and hardness, which allows pressure to be absorbed uniformly and distributed evenly across the body supporting layer 40 of the mattress assembly 10. Once again, such visco-elastic foams can similarly have hardness values in the range of about 10 N to no greater than about 80 N and density values in the range of about 30 kg/m$^3$ to about 150 kg/m$^3$, but it is of course contemplated that a flexible foam, including other flexibles foams such as latex or soft conventional foams, having a desired density, hardness, or other property can also readily be selected for a body supporting layer for a particular application or mattress assembly as desired. In some embodiments, such properties can also be provided by a fiber-based body supporting layer.

The exemplary base layer 70 of the mattress assembly 10 is also comprised of a flexible foam, but the flexible foam of the base layer 70 typically has a density equal to or greater than that of the bottom panel 22 and sidewalls 24 of the tub 20 in order to provide additional support of the tub 20. In certain embodiments, the base layer 70 and bottom panel 22 are made of the same flexible foam and can be combined into a single layer. In other embodiments, the base layer is made of or includes a rigid or semi-rigid material such as plastic or wood to provide even further support. In this way, in some embodiments, the base layer can be considered a foundation or base, such as a box spring, typically used in conjunction with mattresses.

In some further embodiments of the present invention, and although not shown in the Figures, a body supporting layer of an exemplary mattress assembly can be further covered by a comfort portion or layer that is positioned atop the body supporting layer and provides a level of comfort to a body of a user or a portion of thereof that is resting on such an exemplary mattress assembly. The comfort layer can also be comprised of a visco-elastic foam. However, the comfort layer typically has a density, hardness, or both that is less than that of the body supporting layer of the mattress assembly, such that the comfort layer provides a softer surface on which to rest the body of a user or a portion thereof, while also providing a sufficiently soft barrier between the body of a user and the foam arches of the mattress assembly, which may have an increased hardness or density to provide the desired level of compression resistance. For example, in certain embodiments, an exemplary mattress assembly can include a body supporting layer that is comprised of visco-elastic foam with a density of about 80 kg/m$^3$ and a hardness of about 13 N, along with a comfort layer that is comprised of a visco-elastic foam with a density of about 35 kg/m$^3$ and a hardness of about 10 N.

With further regard to the body supporting and comfort layers of the mattress assemblies of the present invention, as indicated above, the body supporting and comfort layers are generally each comprised of a layer of visco-elastic foam having a density and hardness suitable for distributing pressure from a user's body, or portion thereof. However, it is additionally contemplated that an exemplary body supporting portion can be comprised of different or additional layers having various densities and hardnesses. For instance, it is contemplated that a layer of high-resilience polyurethane foam can be used alone or can be secured to the second surface of a layer of low-resilience visco-elastic foam used in a body supporting portion. Such multi-layered body supporting portions are described, for example, in U.S. Pat. Nos. 7,469,437, 7,507,468, 8,025,964, and 8,034,445, each of which is incorporated herein by this reference.

As a further refinement to the mattress assemblies of the present invention, one or more outer covers can also be included and used to cover the various portions of the mattress assemblies. For example, in one embodiment, a fire sock can be first used to surround the body supporting layer and the tub of an exemplary mattress assembly. Then, an outer fabric cover, such as a fabric cover made from a durable and washable fabric material (e.g., a cotton/polyester blend) can be used to cover the fire sock surrounding the body supporting layer and the tub.

As an even further refinement to the present invention, although the support cushion shown in FIGS. 1-2 is in the form of a mattress assembly and is dimensionally sized to support a user lying in a supine or prone position, it is contemplated that the features described herein are equally applicable to head pillows, seat cushions, seat backs, neck pillows, leg spacer pillows, mattress topers, overlays, and the like. As such, the phrase "support cushion" and the like is used herein to refer to any and all such objects having any size or shape, and that are capable of or are generally used to support the body of a user or a portion thereof.

Figure 4:
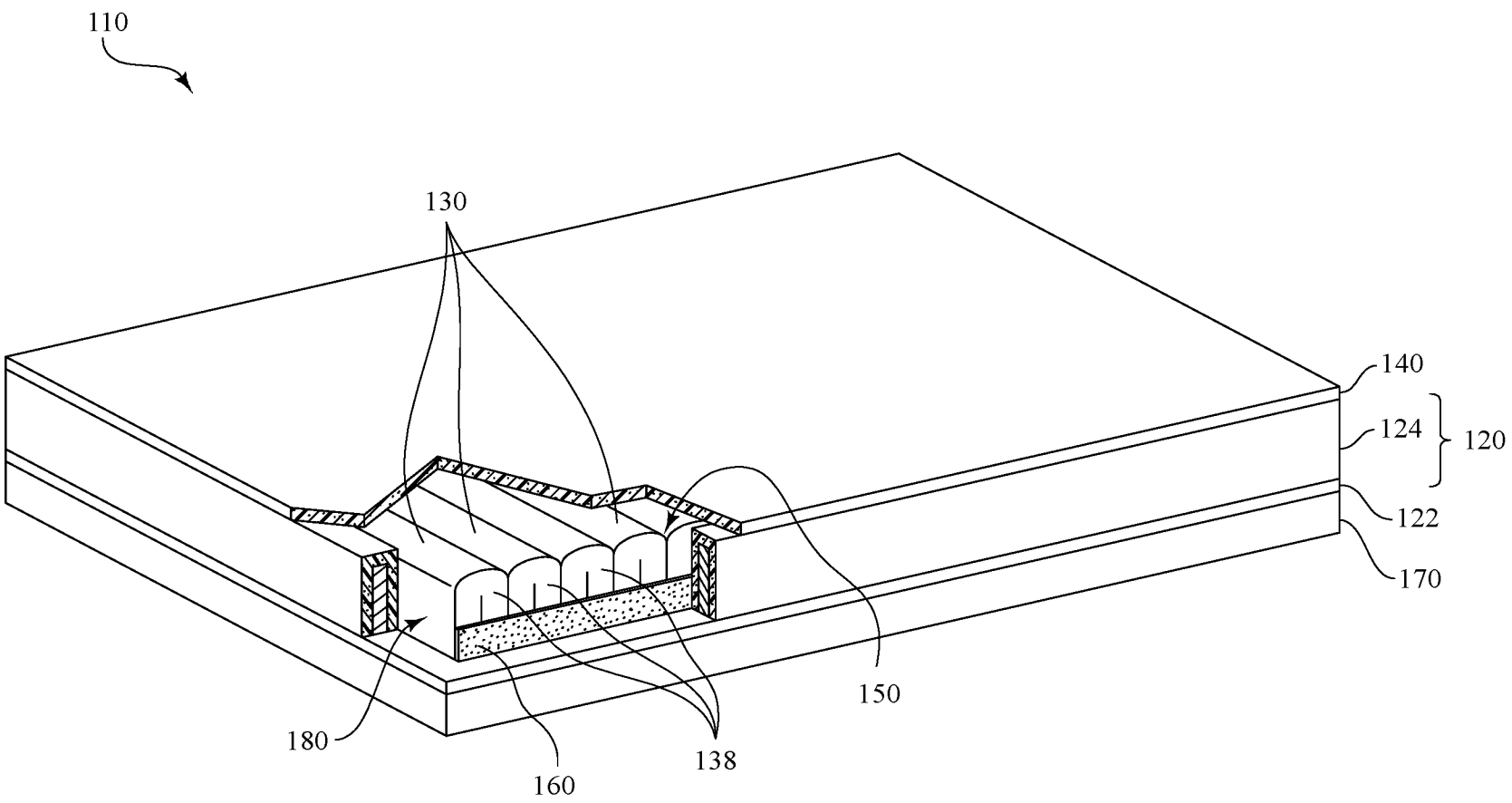
FIG. 4 is a perspective view of another mattress assembly made in accordance with the present invention, and including a portion of the body supporting layer and sidewall of the mattress assembly removed to show underlying foam arches connected by a non-woven material.

As another refinement and as previously mentioned, in some exemplary embodiments the foam arches 30 are formed with an adhesive applied to the inner surface 37 of the foam arch 30 and placed within the tub 20 independent of one another. However, in other embodiments, each of the foam arches are each connected to the adjacent foam arches. In some embodiments, for example, additional adhesive is applied to the outer surface of the foam arches to connect the adjacent foam arches. As another example though, and referring now to FIG. 4, in another exemplary mattress assembly 110, in addition to, or instead of, an adhesive, the foam arches 130 are held together with a fabric band 160 affixed to the edge surface 138 after folding. More specifically, the fabric band 160 extends along the longitudinal axis of the tub 120 adjacent to the sidewall 124 and nearest to the bottom panel 122, i.e., along an end portion of the foam arches 130. Although not expressly shown, another fabric band is affixed to the other end of the foam arches 130 in a similar matter. In this way, the plurality of foam arches 130 connected by the fabric band 160 can be characterized collectively as an insert 180 positioned within the well 150 of the tub 120. The exemplary fabric band 160 is made of a non-woven material and may be glued (e.g., with water based glue or hot melt glue) to the edge surface 138 or welded (e.g., heat welded or sonic welded) to the edge surface 138. However, other materials known in the art can also be used to hold the foam arches together. The height of the fabric band 160 is also non-limited and can extend only a small portion up the edge surface 138 of the foam arches 130 or it can extend up substantially the entire edge surface 138 of the foam arches 130. In some embodiments, a similar fabric band can also be similarly affixed to the bottom of the arches (e.g., the end surfaces) in addition to or instead of on the edge surfaces 138 as shown. The exemplary mattress assembly 110 also includes a body supporting layer 140 and base layer 170 which are substantially similar to the body supporting layer 40 and base layer 70 described above with respect to FIGS. 1-2.

Figure 5:
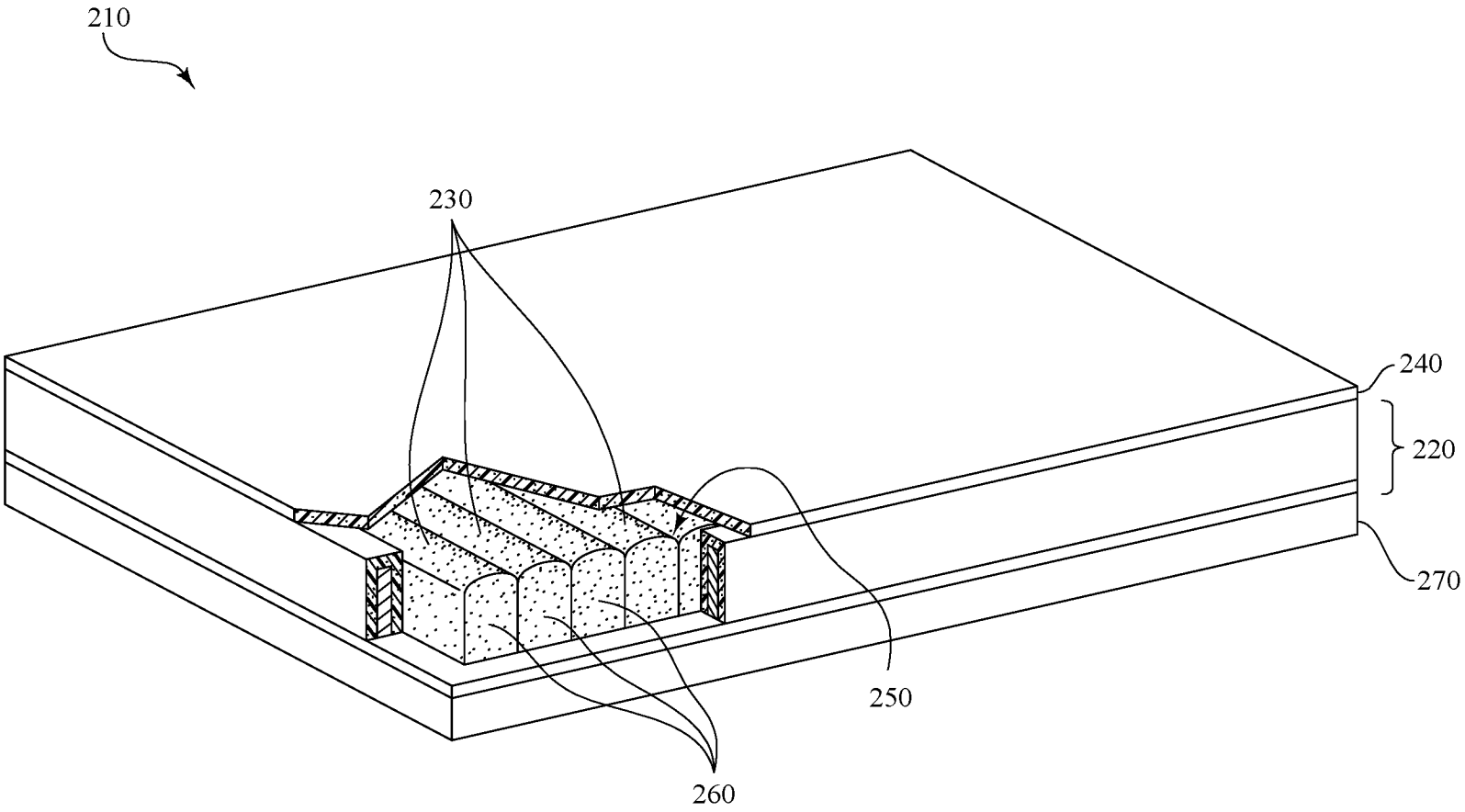
FIG. 5 is a perspective view of another mattress assembly made in accordance with the present invention, and including a portion of the body supporting layer and sidewall of the mattress assembly removed to show underlying foam arches encased in a non-woven material.

Referring now to FIG. 5, in another exemplary mattress assembly 210, the foam arches 230 are placed within the well 250 of the tub 220 independent of one another similar to the arches 30 described above with respect to FIGS. 1-2. However, unlike the arches 30 shown in FIGS. 1-2, the exemplary foam arches 230 shown in FIG. 5 include a fabric 260 that substantially surrounds, or encases, the folded flexible foam. In some embodiments, the fabric 260 can loosely surround the folded flexible foam, but in exemplary embodiment, the fabric 260 is affixed to at least a portion of the underlying folded flexible foam. More specifically, and with reference to the exemplary foam arch 30 shown in FIG. 3B, the fabric 260 can be affixed to the end surfaces 35, the edge surfaces 38, the flat portion of the outer surface 36, and/or the entire outer surface 36. Regardless, the fabric 260 may be affixed to the folded flexible foam with an adhesive (e.g., a water based glue or hot melt glue) or through welding (e.g., heat welding or sonic welding). In some embodiments, the fabric 260 maintains the shape of the foam arch in addition to, or instead of, any other means discussed above. Furthermore, inclusion of the fabric 260 prevents foam-on-foam friction during compression and, more importantly, decompression which improves operation of the mattress. To this end, the exemplary fabric 260 is generally made of a non-woven material but other materials known in the art can also be used to hold the foam arches together and provides lower levels of friction relative to the underlying flexible foam.

Moreover, although the exemplary fabric 260 shown in FIG. 5 completely surrounds and encases the foam arches 230, in other embodiments, a similar fabric can cover only a portion of the fabric arches. For example, the fabric may surround the bottom and sides while leaving the top uncovered; the fabric may leave a portion or the entirety of the upper curved portion uncovered; the fabric may only extend partway up the sides of the foam arches; and/or the bottom of the foam arches may be covered or uncovered. The exemplary mattress assembly 210 also includes a body supporting layer 240 and base layer 270 which are substantially similar to the body supporting layer 40 and base layer 70 described above with respect to FIGS. 1-2.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A support cushion, comprising:

a tub including a flat bottom panel and a sidewall collectively defining a well;

a plurality of foam arches positioned in the well, each foam arch including an upper curved portion, an inner surface, an outer surface, and two end surfaces, and each foam arch positioned in the well such that each upper curved portion is opposite the bottom panel of the tub and the two end surfaces are positioned against the flat bottom panel of the tub, and such that the outer surface of each foam arch is positioned adjacent to and in contact with an outer surface of another one of the plurality of foam arches along a length of the outer surface extending from the upper curved portion to a respective one of the two end surfaces of each foam arch; and a body supporting layer having a first surface and a second surface opposite the first surface, the second surface positioned over the well and atop the plurality of flexible foam arches, wherein the inner surface of each foam arch is connected to itself to maintain a shape of each foam arch.

2. The support cushion of claim 1, wherein the well of the tub has a width, and wherein each foam arch has a length spanning the width of the well.

3. The support cushion of claim 2, wherein the tub has a longitudinal axis, and wherein the upper curved portion of each foam arch extends in a same direction as the longitudinal axis of the tub.

4. The support cushion of claim 1, wherein each foam arch is independent from each other foam arch.

5. The support cushion of claim 1, wherein each foam arch is encased in a fabric.

6. The support cushion of claim 1, wherein each foam arch is affixed to an adjacent foam arch.

7. The support cushion of claim 1, further including a fabric band extending along a longitudinal axis of the tub, the fabric band affixed to an edge surface of each foam arch to connect the plurality of foam arches.

8. The support cushion of claim 1, wherein each foam arch is in the shape of a round arch.

9. The support cushion of claim 1, wherein the body supporting layer and the plurality of foam arches are comprised of a flexible foam.

10. The support cushion of claim 9, wherein the body supporting layer is comprised of a visco-elastic foam.

11. The support cushion of claim 9, wherein the tub is comprised of a flexible foam; and wherein the flexible foam comprising the body supporting layer has a density less than a density of the flexible foam comprising the tub.

12. The support cushion of claim 9, wherein the sidewall of the tub includes an inner support encased in a flexible foam.

13. A mattress assembly, comprising a tub including a flat bottom panel and a sidewall collectively defining a well, the well having a width;

a plurality of foam arches positioned in the well, each foam arch having a length spanning the width of the well and including an upper curved portion, an inner surface, an outer surface, and two end surfaces, and each foam arch positioned in the well such that each upper curved portion is opposite the bottom panel of the tub and extends in a same direction as a longitudinal axis of the tub and the two end surfaces are positioned against the flat bottom panel of the tub, and such that the outer surface of each foam arch is positioned adjacent to and in contact with an outer surface of another one of the plurality of foam arches along a length of the outer surface extending from the upper curved portion to a respective one of the two end surfaces of each foam arch; and a body supporting layer having a first surface and a second surface opposite the first surface, the second surface positioned over the well and atop the plurality of foam arches, and wherein the inner surface of each foam arch is connected to itself to maintain a shape of each foam arch.

14. The support cushion of claim 13, wherein each foam arch is independent from each other foam arch.

15. The support cushion of claim 13, wherein each foam arch is encased in a fabric.

16. The support cushion of claim 13, wherein each foam arch is affixed to an adjacent foam arch.

17. The support cushion of claim 13, further including a fabric band extending along a longitudinal axis of the tub, the fabric band affixed to an edge surface of each foam arch to connect the plurality of foam arches.

18. The support cushion of claim 13, wherein each foam arch is in the shape of a round arch.

19. The support cushion of claim 13, wherein the body supporting layer and the plurality of foam arches are comprised of a flexible foam.

20. The support cushion of claim 19, wherein the body supporting layer is comprised of a visco-elastic foam.

21. The support cushion of claim 19, wherein the tub is comprised of a flexible foam; and wherein the flexible foam comprising the body supporting layer has a density less than a density of the flexible foam comprising the tub.

22. The support cushion of claim 19, wherein the sidewall of the tub includes an inner support encased in a flexible foam.

23. A foam insert for use in a mattress assembly, the foam insert comprising:

a plurality of foam arches, each foam arch having a length and including edge surfaces on either end of the length of the foam arch, an outer surface, an inner surface opposite the outer surface, an upper curved portion extending perpendicular to a direction of the length of the foam arch, and a flat end portion opposite the upper curved portion;

a fabric band affixed to each edge surface of the plurality of foam arches and extending along a longitudinal axis of the plurality of foam arches to connect the plurality of foam arches together, wherein the outer surface of each foam arch is positioned adjacent to and in contact with the outer surface of another one of the plurality of foam arches along a portion of each foam arch extending from the upper curved portion to a respective one of the end surfaces of each foam arch, and wherein the inner surface of each foam arch is connected to itself to maintain a shape of each foam arch.

24. The foam insert of claim 23, wherein each of the foam arches is made by bending a slab of foam having a first surface, a second surface opposite from the first surface, and two end surfaces that extend between the first surface and the second surface along a long axis of the slab of foam such that the two end surfaces are brought towards each other to form the flat end portion of the foam arch.

* * * * *